US005228625A

United States Patent [19]

Grassberger

[11] Patent Number: 5,228,625

[45] Date of Patent: Jul. 20, 1993

[54] SPRINKLER HEAD

[75] Inventor: Roland Grassberger, Brussels, Belgium

[73] Assignee: Masco GmbH, Sandhausen, Fed. Rep. of Germany

[21] Appl. No.: 772,355

[22] PCT Filed: Feb. 20, 1991

[86] PCT No.: PCT/DE91/00137

§ 371 Date: Oct. 22, 1991

§ 102(e) Date: Oct. 22, 1991

[87] PCT Pub. No.: WO91/12894

PCT Pub. Date: Sep. 5, 1991

[30] Foreign Application Priority Data

Feb. 22, 1990 [DE] Fed. Rep. of Germany ..... 4005569

[51] Int. Cl.[5] ..... B05B 1/14; B05B 15/08

[52] U.S. Cl. ..... 239/558; 239/104; 239/533.14; 239/587.1; 239/602

[58] Field of Search ..... 239/602, 548, 558, 104, 239/533.1, 533.14, 533.13, 587.1

[56] References Cited

U.S. PATENT DOCUMENTS

| | | | |
|---|---|---|---|
| 2,402,741 | 6/1946 | Draviner | 239/533.14 |
| 2,860,920 | 11/1958 | Waller | 239/558 |
| 3,322,252 | 5/1967 | Alcantara | 239/428.5 |
| 3,342,419 | 9/1967 | Weese | 239/533.13 |
| 3,383,050 | 5/1968 | Crist et al. | 239/533.14 |
| 3,402,893 | 9/1968 | Hindman | 239/533.14 |
| 3,979,064 | 9/1976 | Nordentoft | 239/533.14 |

FOREIGN PATENT DOCUMENTS

| | | | |
|---|---|---|---|
| 3044310 | 6/1982 | Fed. Rep. of Germany . | |
| 736942 | 12/1932 | France | 239/533.14 |
| 2149081 | 3/1973 | France . | |
| 2119285 | 11/1983 | United Kingdom | 239/533.13 |

*Primary Examiner*—Andres Kashnikow
*Assistant Examiner*—Christopher G. Trainor
*Attorney, Agent, or Firm*—Anderson Kill Olick & Oshinsky

[57] ABSTRACT

In a sprinkler head comprising a sprinkler body (1) and a sprinkler base (4), the nozzle wall of the sprinkler base (4) is the fixed supporting plate (8) of a rubber-elastic nozzle plate (11) resting on it. The nozzle plate (11) comprises a plurality of elastic nozzle projections (12) formed on it which engage in receiving bore holes (9) of the supporting plate (8). The axial length of the elastic nozzle projections (12) in relation to that of the receiving bore holes (9) is such that their elastically deformable ends always project beyond the outer surface (14) of the supporting plate (8). Furring of the nozzle projections can easily be removed by exerting a slight external force on the elastically deformable ends. Nevertheless, the spray-forming outlet ends of the nozzle projections (12) are so thick-walled and of such material quality that they withstand ordinary water pressures and therefore have good spray guidance properties.

11 Claims, 1 Drawing Sheet

SPRINKLER HEAD

The invention is directed to a sprinkler head comprising a sprinkler body having an inlet and an outlet, a sprinkler base which is detachably fastened at the sprinkler body and closes the outlet, and a rubber-elastic nozzle plate which contacts a fixed supporting plate of the sprinkler base and comprises a plurality of formed on elastic nozzle projections which engage in corresponding receiving bore holes of the supporting plate, have a greater axial length than the respective receiving bore holes of the supporting plate and whose elastically deformable ends project over the outer surface of the supporting plate also when not acted upon by the pressure of liquid.

In a known sprinkler head (U.S. Pat. No. 2,402,741), in which the nozzle projections, however, do not project over the outer surface of the supporting plate, the dimensioning of the liquid ducts in the nozzle projections which adapts itself automatically and in an elastic manner to the different liquid pressures ensures that the exiting spray remains spread out also at low liquid pressures and the individual streams do not combine, e.g. shortly after exiting the sprinkler head, to form a single coarse spray. As a result of the liquid ducts in the nozzle projections which expand and contract elastically, according to the degree of liquid pressure, a self-cleaning effect is also achieved for the sprinkler head, so that solids are discharged and furring is broken off and rinsed out through the nozzle openings.

However, the self-cleaning action of this known sprinkler head is not sufficient, particularly with hard or very hard tap water, for eliminating the rapidly and massively forming furring or for removing it to the extent that it does not interfere with the spray formation. In addition, the deposits forming immediately outside the nozzle openings of the known sprinkler head are not eliminated or are only eliminated to an insufficient degree by means of the self-cleaning action of the known sprinkler head.

In a known sprinkler head (DE 31 07 808 A1) of the generic type indicated in the beginning a self-cleaning action is likewise achieved for the nozzle projections, which are described in the latter as pipes. For this purpose, it is provided that the nozzle projections are constructed as relatively thin-walled pipes, whose portion situated downstream collapses or folds up and closes the respective spray outlet opening when there is no application of pressure. Accordingly, the through-openings are sealed to a great extent against the atmosphere, so that the water present in the sprinkler head cannot dry up accompanied by the formation of furring. On the other hand, when the sprinkler is in operation the thin-walled pipes are supposed to expand elastically, so that every possible incrustation is flaked off already in the initial stage and washed away with the sprinkler water.

This known sprinkler head may have the desired self-cleaning effect, but the use of thin-walled tubular nozzle projections is disadvantageous for the spray pattern produced by the sprinkler head. Namely, the thin-walled nozzle projections undergo different elastic expansion depending on the water pressure. At low pressures the exiting spray is constricted by means of the thin-walled nozzle projections, while at higher pressures the expansion of the nozzle projections can proceed to the extent that the water spray is no longer adequately guided through the nozzle projections.

Therefore, it is obvious that an acceptable spray pattern cannot be achieved with this known sprinkler head in view of water pressures which normally vary within limits as wide as 0.5 to 5 bar.

The object of the invention is to provide an improved sprinkler head in which the nozzle projections do not undergo any deformations impairing the spray pattern at normal water pressures and in which it is nevertheless possible to remove the external furring at the nozzle openings completely or at least to a great extent.

The proposed object is met proceeding from the generic type of sprinkler head indicated in the beginning in that the spray-forming output ends of the nozzle projections are constructed so as to be thick-walled and to withstand ordinary water pressures, but are externally deformable by means of mechanical action, wherein the nozzle plate with the nozzle projections which are formed on so as to form one piece is shaped from a rubber-elastic material having a Shore hardness of approximately 40 to 50, and wherein the elastically deformable ends of the nozzle projections project over the outer surface of the supporting plate by an amount corresponding to approximately one to two times the outer diameter of the nozzle projections.

In the sprinkler head, according to the invention, on the one hand, the spray-forming output ends of the nozzle projections are not expanded by the water pressure due to their thick-walled construction and the indicated selection of material, so that they deliver a well-guided water spray with a defined spray pattern under all operating conditions. On the other hand, even when the sprinkler is not in use, i.e. when no water flows through the sprinkler head, the nozzle projections always project far enough over the outer surface of the supporting plate of the sprinkler base so that the projecting ends can be accessed e.g. by the user's hand or finger and can be pressed together and/or bent accompanied by elastic deformation by hand, wherein they resist mechanical external deformation in the manner of a rubber eraser due to their construction and material. Persistently adhering deposits are also easily detached from the rubber-elastic material of the nozzle projections, wherein precisely the external furring located on the nozzle openings can be accessed by the hand or finger and can be easily detached and removed. When repeated often enough before or after the shower process, furring is prevented from building up at all to a considerable extent. This results in a sprinkler head which provides a constant optimal spray pattern over long periods of use with extremely low expenditure of labor on the part of the user. The nozzle plate can be produced easily from a suitable relatively soft rubber material. Correspondingly soft elastomer plastics materials are also suitable.

The thick-walled construction is preferably achieved in such a way that the cross-sectional area formed by the outer diameter at the output end of the nozzle projections is approximately 7 to 10 times greater than the outlet cross-sectional area formed by the inner diameter of the spray outlet opening.

The liquid ducts in the nozzle projections are advantageously constructed as stepped bore holes with a greater inlet cross section and a smaller outlet cross section. If the axial longitudinal area of the greater inlet cross section of the liquid ducts projects over the outer surface of the supporting plate, the elastic deformability of the ends of the nozzle projections projecting over the outer surface of the supporting plate is further increased, which further facilitates the removal of any deposits from the liquid ducts and/or at the outlet openings.

It has proven advantageous with respect to deformation by means of external mechanical force if the cross-sectional area formed by the outer diameter of the nozzle projections is approximately 3 to 5 times greater than the input cross-sectional area formed by the diameter of the input cross section.

It has been shown that the formation of deposits can be reduced if the axial longitudinal area of the smaller outlet cross section of the liquid ducts has a polygonal, preferably square cross-sectional shape.

In order to avoid injuries from sharp-edged nozzle projections, the nozzle projections are advisably rounded off at their ends in the manner of a spherical cap.

The supporting plate can be planar and provided with receiving bore holes which are aligned parallel to one another. However, the supporting plate is preferably arched or curved outward at least at its supporting surface for the rubber-elastic nozzle plate, wherein the receiving bore holes are arranged so as to diverge from one another in the flow direction proceeding from the supporting surface. With this preferred arrangement, a more or less spread out spray pattern is produced depending on the curvature of the supporting plate and the axial divergence of the receiving bore holes.

In order to fix the nozzle plate inside the sprinkler base in a sealed manner, it is advantageous if the nozzle plate is clamped in at its circumferential edge between an annular surface of the sprinkler body and the supporting plate when the sprinkler base is fastened at the sprinkler body. In order to improve the clamping and sealing effect it is advisable to provide the circumferential edge of the nozzle plate with an annular rib which faces the supporting plate and engages in a corresponding annular groove of the supporting plate.

Further, it may be advisable, depending on the construction of the sprinkler head, to insert a pressure ring between the annular surfaces of the sprinkler body and the circumferential edge of the nozzle plate. If the sprinkler base is screwed together with the sprinkler body by means of a circumferential threaded engagement, the pressure ring ensures that the circumferential edge of the rubber-elastic nozzle plate is not carried along in the circumferential direction by friction so as to prevent shearing stresses at the nozzle projections engaging in the receiving bore holes of the supporting plate.

The sprinkler head can also be constructed in such a way that it does not produce any geometrically fixed spray pattern, but rather so that the spray pattern can be adjusted for different spreading. For this purpose, in another embodiment form of the invention, the supporting plate of the sprinkler base is constructed so as to be bendable in an elastic manner and its threaded part, which is fastened at it concentrically, engages with a complementary threaded part fastened at the sprinkler body so as to be adjustable by means of screwing in order to achieve different curvatures of the supporting plate. The supporting plate curves to a greater or lesser extent, corresponding to a greater or smaller spreading out of the spray, depending on the axial adjustment position of the complementary threaded parts.

The invention is explained in more detail in the following with reference to drawings showing two embodiment examples:

Figure 1:
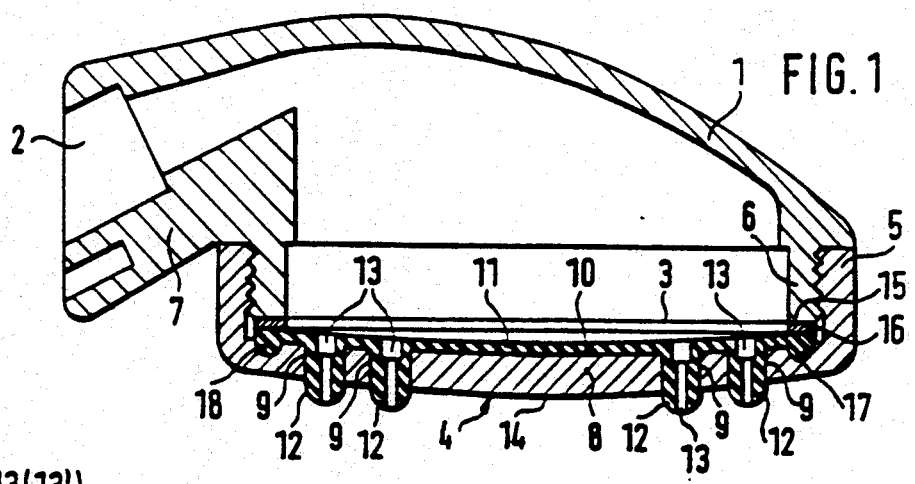
FIG. 1 shows a longitudinal section through a sprinkler head in a first, simple embodiment form.

The simple sprinkler head shown in FIG. 1 in a first embodiment form substantially consists of a sprinkler body 1 with inlet 2 and outlet 3 and a sprinkler base 4. The sprinkler base 4 comprises a cylindrical circumferential edge 5 with an internal thread, by means of which it is screwed on a cylindrical annular projection 6 of the sprinkler body 1 provided with a corresponding external thread. The annular projection 6 encloses the outlet 3 of the sprinkler body 1. The inlet 2 is located in a lateral projection 7 of the sprinkler body 1 intended for the connection of a line (not shown) communicating with the inlet 2 and possibly a handle (not shown).

A fixed supporting plate 8, which closes the outlet 3, is connected to the circumferential edge 5 so as to form one piece. The supporting plate 8 is curved outward in the shown example for the purpose of widening the spray and comprises two concentric circular rows of receiving bore holes 9 which are arranged so as to diverge from one another slightly as seen in the direction of flow corresponding to the curvature of the supporting plate 8. The receiving bore holes 9 can also be arranged in a different geometric configuration depending on the desired characteristics of the sprinkler spray. Thus, the central area of the supporting plate 8 is shown in the example as a closed wall. But receiving bore holes can also be provided in this area. In the shown example, the supporting plate 8, in its entirety, is provided with a curvature. However, it would be sufficient for the intended purpose of widening the spray if only its inner surface were curved, which inner surface serves as supporting surface 10 for the nozzle plate 11, described in more detail in the following.

The nozzle plate 11 which is constructed from a relatively soft rubber or a corresponding elastomer plastic comprises a quantity of formed on elastic nozzle projections 12 corresponding to the quantity of receiving bore holes 9 in the supporting plate 8, the relative distance between the nozzle projections 12 and their diameter being dimensioned in such a way that the nozzle projections 12 can be inserted into the assigned receiving bore holes 9. The nozzle plate 11 can be produced as a planar structural component part, since it can easily adapt itself to the curvature of the supporting plate 8 due to the elasticity of its material. The liquid ducts 13 in the nozzle projections 12, whose alignment is predetermined by the axial direction of the receiving bore holes 9 when the nozzle plate 11 is arranged on the supporting plate 8, are constructed as simple stepped bore holes in the shown example, wherein the area of the stepped bore hole which is greater in diameter faces the interior of the sprinkler body 1, while the areas of the stepped bore hole having a smaller diameter form the nozzle outlet cross section.

As can be clearly seen in FIG. 1, the axial length of the elastic nozzle projections 12 is substantially greater than that of the respective receiving bore holes 9, so that the outer ends of the nozzle projections 12 clearly project over the outer surface 14 of the supporting plate 8. The outer ends of the nozzle projections 12 can therefore easily be elastically deformed by means of the application of slight external force, so that they can be freed of possible furring in a simple manner. For this purpose, it may be sufficient under certain circumstances if the outer surface 14 of the sprinkler head is drawn past a suitable edge of the shower device, wherein the outer ends of the nozzle projections are deformed one after the other and restored to their initial position in an elastic manner. It is therefore not absolutely necessary to deform the nozzle projections directly by hand or with the fingers.

As also follows from FIG. 1, the nozzle plate 11 is securely clamped by its circumferential edge between the annular surface 15 of the annular projection 6 and the supporting plate 8, wherein the clamping results when the sprinkler base 4 is screwed onto the sprinkler body 1. A pressure ring 16 is inserted between the annular surface 15 and the nozzle plate 11 and prevents relative movements between the annular projection 6 and the supporting plate 8 from being transmitted to the elastic nozzle plate 11 during screwing movements of the sprinkler base 4. The pressure ring 16 rests on the nozzle plate 11 and participates in the screwing movements of the sprinkler base 4, wherein it slides on the annular surface 15 when it reaches the latter when screwed on or when it is separated from it when unscrewed.

The circumferential edge of the nozzle plate 11 is provided with an annular rib 17 which engages in a corresponding annular groove 18 of the supporting plate 8. This engagement ensures that the nozzle plate 11 is also connected with the supporting plate 8 in its edge area in a positive-locking manner, wherein this positive locking is also not canceled during the clamping of the circumferential edge of the nozzle plate 11 described above.

Figure 3:
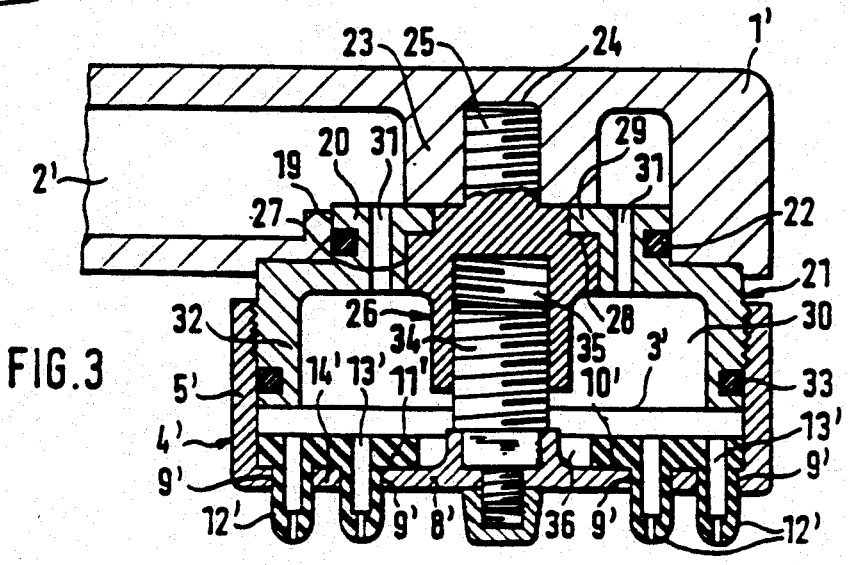
FIG. 3 shows a longitudinal section through a second embodiment example of the sprinkler head in a broken away view.

A sprinkler head in which the spreading angle of the emerging sprinkler spray is adjustable within certain limits is shown in the embodiment example according to FIG. 3. In the shown example, the construction of the sprinkler head which is described in the following is provided for this purpose. A corresponding cylindrical projection 20 of a cup-shaped housing part 21 is inserted in a cylindrical opening 19 of the sprinkler head 1' so as to be sealed with the intermediary of an O-ring seal 22. The cylindrical projection 20 contacts the end face of an inner, cylindrically constructed fastening projection 23 of the sprinkler body 1' which is arranged coaxially relative to the housing part 21. The fastening projection 23 is provided with a central threaded bore hole 24 in which a stepped bolt 26 comprising a threaded pin 25 is screwed in for fastening the housing part 21 at the sprinkler body 1'. The stepped bolt 26 is guided through a correspondingly stepped inner bore hole 27 of the housing part 21 and contacts an annular projection 29 of the housing part 21 with an annular surface 28, which annular projection 29 projects radially inward out of the inner bore hole 27.

The fastening projection 23 is arranged in such a way that it does not impede the flow through the sprinkler head proceeding from the inlet 2'. The inlet 2' communicates with an annular inner chamber 30 of the housing part 21 via a plurality of through-flow ducts 31. An annular wall 32 which defines the inner chamber 30 on the outside and corresponds in function to the annular projection 6 of the first embodiment form described with reference to FIG. 1 carries an external thread on which the circumferential edge 5' of the sprinkler base 4' is screwed, the circumferential edge 5' being provided with a corresponding internal thread. The end of the annular wall 32 opening downward defines the outlet 3' of the sprinkler body 1' which is complemented by the housing part 21. An additional O-ring seal 33 serves to seal between the annular wall 32 and the circumferential edge 5' of the sprinkler base 4'.

The supporting plate 8', which adjoins the circumferential edge 5' so as to form one piece in this second embodiment form as well, is constructed in such a way that it can be bent more or less elastically in the axial direction. For this purpose, a threaded projection 34 which projects inward coaxially is fastened in its center so as to be fixed against rotation and is screwed into a corresponding threaded bore hole 35 of the stepped bolt 26.

The sprinkler base 4' and the housing part 21 are rotated together in order to change the curvature of the supporting plate 8, wherein the threaded projection 34 is screwed further into or out of the threaded bore hole 35 of the stepped bolt 26, which is securely screwed to the sprinkler body 1', depending on the direction of rotation. Of course, suitable additional constructional measures can be taken to prevent the occurrence of a relative screwing movement between the annular wall 32 and the circumferential edge 5' of the sprinkler base 4' during the screwing movement.

Figure 2:
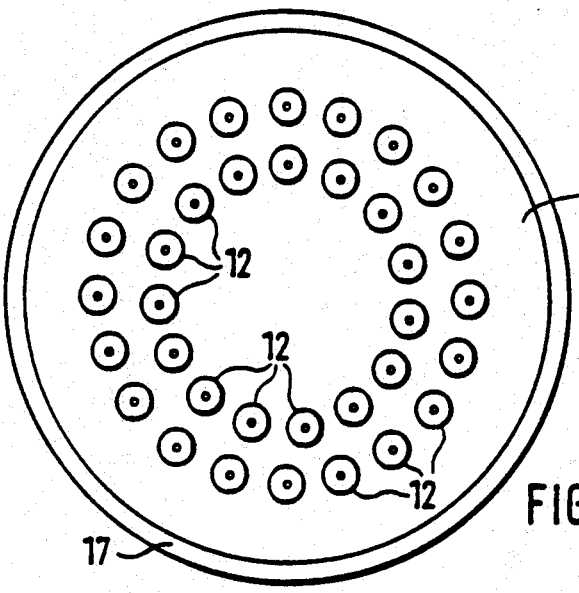
FIG. 2 shows a view from below of the nozzle plate used with the sprinkler head according to FIG. 1.

A nozzle plate 11' which is provided with formed on elastic nozzle projections 12' and with a central through-opening 36 for the passage of the threaded projection 34 and which closely contacts the supporting surface 10' of the supporting plate 8' is also provided in this embodiment form. Due to its elasticity, the nozzle plate 11' fits the differently adjusted curvatures of the supporting plate 8'. The nozzle projections 12' have a substantially greater axial length than that of the receiving bore holes 9' provided in the supporting plate 8'. The ends of the nozzle projections 12', which are easily deformable by means of slight external application of pressure also in this instance, are rounded in a cap-shaped manner as has already been shown in FIGS. 1 and 2, which refer to the first embodiment form. In this case, also, the liquid ducts 13' inside the nozzle projections 12' are stepped, wherein the smallest opening cross section is provided at the outlet opening. Of course, additional constructional steps can be taken at the sprinkler base 4' to prevent water from exiting from the sprinkler head past the nozzle plate 11' directly out through the receiving bore holes 9' along the nozzle projections 12.

Figure 4:
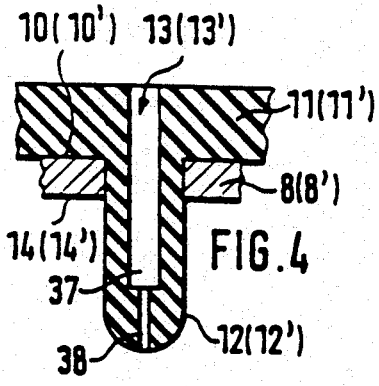
FIG. 4 shows a longitudinal section through an individual nozzle projection in a broken away and enlarged view.
Figure 5:
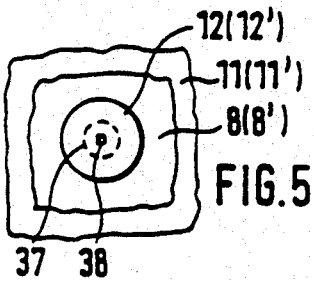
FIG. 5 shows a view of the nozzle projection, according to FIG. 4, from below.

The individual nozzle projection 12 (12') shown in FIGS. 4 and 5 substantially corresponds to the second embodiment form according to FIG. 3, but the nozzle projections 12 of the first embodiment form can also be constructed as shown in FIGS. 4 and 5. In the shown example, the elastically deformable end of the nozzle projection 12 (12') projects over the outer surface 14 (14') of the supporting plate 8 (8') by an amount corresponding to approximately twice the outer diameter of the cylindrical nozzle projection, i.e. by approximately 6 mm with an outer diameter of approximately 3 mm.

As illustrated in FIG. 4, the stepped liquid duct 13 (13') comprises an axial longitudinal area 37 having a larger cross section and an axial longitudinal area 38 having a smaller cross section, wherein the latter forms the spray-shaping outlet cross section. In the shown example, the latter has a square cross section, as is illustrated by FIG. 5. The cap-shaped rounding off of the end of the nozzle projection 12 (12') has the approximate shape of a spherical cap.

At all water pressures occurring in practice, a very good spray guidance was achieved with easy manual deformability of the nozzle projections when the cross-sectional area of the nozzle projections formed by the outer diameter was approximately 12.5 $mm^2$ with an outlet cross-sectional area of approximately 1.44 $mm^2$, i.e. approximately 8.7 times greater than the outlet cross-sectional area. The input cross-sectional area of the liquid ducts was approximately 3.14 $mm^2$, i.e. the cross-sectional area of approximately 12.5 $mm^2$ formed by the outer diameter was approximately 4 times greater than the input cross-sectional area.

Relatively thick-walled nozzle projections were obtained with the cross-sectional area proportions indicated above, which nozzle projections were not deformed by water pressures up to approximately 5 bar, but could be deformed externally by mechanical or manual action easily enough in order to eliminate or prevent furring.

I claim:

1. Sprinkler head comprising a sprinkler body (1) with an inlet (2) and an outlet (3), a sprinkler base (4), which is detachably fastened at the sprinkler body (1) and closes the outlet (3), and a rubber-elastic nozzle plate (11) which contacts a fixed supporting plate (8) of the sprinkler base (4) and comprises a plurality of elastic nozzle projections (12) which engage in corresponding receiving bore holes (9) of the supporting plate (8), have a greater axial length than the respective receiving bore holes (9) of the supporting plate (8) and whose elastically deformable ends project over the outer surface (14) of the supporting plate (8) also when not acted upon by the pressure of liquid, characterized in that the nozzle projections (12, 12') have spray-forming output ends which are constructed so as to be thick-walled to withstand ordinary water pressures, the cross-sectional area formed by the outer diameter at the output end of the nozzle projections (12, 12') being approximately 7 to 10 times greater than the outlet cross-sectional area formed by the inner diameter of a spray outlet opening, but are externally deformable by hand for removal of external furring at the output ends of the nozzle projections wherein the nozzle plate (11, 11') and the nozzle projection (12, 12') are formed so as to form one piece shaped from a rubber-elastic material having a Shore hardness of approximately 40 to 50, and wherein the elastically hand-deformable ends of the nozzle projections (12, 12') project over the outer surface (14, 14') of the supporting plate (8, 8') by an amount corresponding to approximately one to two times the outer diameter of the nozzle projections.

2. Sprinkler head according to claim 1, characterized in that the nozzle projections (12, 12') have liquid ducts (13, 13') which are constructed as stepped bore holes with a greater inlet cross section and a smaller outlet cross section.

3. Sprinkler head according to claim 2, characterized in that the axial longitudinal area (37) of the greater inlet cross section of the liquid ducts (13, 13') projects over the outer surface (14, 14') of the supporting plate (8, 8').

4. Sprinkler head according to claim 1, characterized in that the cross-sectional area formed by the outer diameter of the nozzle projections (12, 12') is approximately 3 to 5 times greater than the cross-sectional area formed by the diameter of the inlet cross-section of the stepped bore hole.

5. Sprinkler head according to one of claim 1, characterized in that the portion of the stepped bore hole having the smaller outlet cross section has a polygonal, shape.

6. Sprinkler head according to one of claim 1, characterized in that the nozzle projections (12, 12') are rounded off at their ends in a cap-shaped manner.

7. Sprinkler head according to claim 1, characterized in that the supporting plate (8) is curved outward at least at a supporting surface (10) for the rubber-elastic nozzle plate (11), and in that the receiving bore holes (9) are arranged so as to diverge from one another proceeding from the supporting surface (10) in the direction of flow.

8. Sprinkler head according to claim 7, characterized in that the nozzle plate (11) is clamped in at its circumferential edge between an annular surface (15) of the sprinkler body (1) and the supporting plate (8) when the sprinkler base (4) is fastened at the sprinkler body (1).

9. Sprinkler head according to claim 8, characterized in that the circumferential edge of the nozzle plate (11) is provided with an annular rib (17) which faces the supporting plate (8) and engages in a corresponding annular groove (18) of the supporting plate (8).

10. Sprinkler head according to claim 8, characterized in that a pressure ring (16) is inserted between the annular surface (15) of the sprinkler body (1) and the circumferential edge of the nozzle plate (11).

11. Sprinkler head according to claim 1, characterized in that the supporting plate (8') of the sprinkler base (4') is constructed so as to be bendable in an elastic manner, said supporting plate (8') having a concentrically located threaded part (34) that engages with a complementary threaded part (26, 35) fastened at the sprinkler body (1') so as to be adjustable by means of screwing in order to achieve different curvatures of the supporting plate (8').

* * * * *